US009624683B1

(12) United States Patent
Lopez

(10) Patent No.: US 9,624,683 B1
(45) Date of Patent: Apr. 18, 2017

(54) RECIPROCATING IN-FLOOR POOL CLEANER HEAD WITH ADJUSTABLE NOZZLES

(71) Applicant: Pool Patch LLC, Phoenix, AZ (US)

(72) Inventor: Thomas V. Lopez, Phoenix, AZ (US)

( * ) Notice: Subject to any disclaimer, the term of this patent is extended or adjusted under 35 U.S.C. 154(b) by 254 days.

(21) Appl. No.: 14/504,320

(22) Filed: Oct. 1, 2014

(51) Int. Cl.
*E04H 4/12* (2006.01)
*E04H 4/16* (2006.01)

(52) U.S. Cl.
CPC ..... *E04H 4/1245* (2013.01); *E04H 4/169* (2013.01)

(58) Field of Classification Search
CPC ..... E04H 4/1245; E04H 4/16; E04H 4/169; B05B 3/0418; B05B 3/0422; B05B 3/0427; B05B 3/16; B05B 12/06; B05B 15/10
USPC ..... 4/490, 492; 239/201–206, 538
See application file for complete search history.

(56) References Cited

U.S. PATENT DOCUMENTS 4,322,860 A 4/1982 Gould
4,466,142 A 8/1984 Gould
4,471,908 A * 9/1984 Hunter ..... B05B 15/10 239/11
4,986,474 A * 1/1991 Schisler ..... B05B 3/005 239/205
6,393,629 B1 5/2002 Barnes et al.
6,601,244 B1 8/2003 Goettl
6,899,285 B2 * 5/2005 Goettl ..... E04H 4/169 239/200
6,971,588 B1 12/2005 Tarr et al.
8,533,874 B1 * 9/2013 Goettl ..... E04H 4/169 134/167 R
8,590,071 B1 * 11/2013 Lopez ..... E04H 4/169 239/204
8,984,677 B1 * 3/2015 Lopez ..... E04H 4/169 239/204
2011/0225716 A1 9/2011 Malinasky
2016/0002943 A1 * 1/2016 Lopez ..... E04H 4/169 4/490

* cited by examiner

*Primary Examiner* — J. Casimer Jacyna
(74) *Attorney, Agent, or Firm* — Thomas W. Galvani, P.C.; Thomas W. Galvani

(57) ABSTRACT

A device for use in a swimming pool structure includes an insert defining a chamber and including a lower surface disposed within the chamber. The device includes a piston having a plurality of nozzles, and a cap having an outlet, the cap mounted for rotation among a plurality of positions each aligning the outlet in the cap with one of the nozzles in the piston. The piston is carried in the chamber for reciprocal movement between a lowered position and a raised position in which one of the nozzles is aligned with the outlet, and the one of the nozzles and the outlet are free of obstruction above the insert.

22 Claims, 10 Drawing Sheets

10
23
42
63
E
64
A
44
43
C
11
45
53
B
46
D
50
51
61
56
54
55
52
25
32
31
30
22
24
175
12
164
21
144
20
153
151
I
145
152
95
83
14
171
172
173
174
170
163
70
162
141
143
142
15
F
72
84
74
81
82
51
80
60
G
100
H
75
102
71

111
140
110
103
16
105
131
132
104
124
130
133
114
122
123
125
113
115
13
121
120

RECIPROCATING IN-FLOOR POOL CLEANER HEAD WITH ADJUSTABLE NOZZLES

FIELD OF THE INVENTION

The present invention relates generally to swimming pools, and more particularly to automated systems for cleaning pool surfaces.

BACKGROUND OF THE INVENTION

Some swimming pool structures are constructed with cleaning systems in which cleaner heads are installed in the floor and steps of the pool and direct jets of water across the inner surface of the pool to move debris collected on the inner surface toward a drain, where the debris is drawn into a circulation system for filtering. The circulation system typically includes the drain, an intake or upstream piping assembly coupled to the drain, and a pump for drawing water into the drain and through the upstream piping assembly to a filter for filtration. Filtered water is then communicated out through an outlet or downstream piping assembly to the heads installed in the floor and steps of the pool. The heads are applied to collars mounted in the floor of the pool structure in fluid communication with the piping assembly. The collars are generally installed flush with the floor of the pool.

Various manufacturers have developed several designs for cleaner heads. One commonly-used head includes a cylindrical insert carrying a piston formed with a nozzle. A guide pin extending from a sidewall of the piston navigates a sinusoidal maze on the inner surface of the insert, and as the guide pin moves through the maze in response to the flow of water through the head, the piston moves up, down, and in rotation, sequentially moving through several nozzle stations or orientations. Water applied through the head is thus directed in different directions in response to movement of the piston. This head, however, is prone to wear and breaking. The pin often snaps off, so that the piston then freely rotates within the insert without guidance. Further, as mineral deposits build up and some debris inevitably passes through the filter into the head, the maze often becomes clogged and prevents the piston from moving. The piston will thus become stuck in an up, down, or partially raised position, requiring maintenance. The piston can also become stuck when this build-up or debris becomes lodged between the piston and the insert. Further, because most pool cleaning systems are programmed to operate at night, away from the pool owner's watch, a stuck head will often go unnoticed and can cause a portion of a pool surface to remain uncleaned for a significant period of time. An improved cleaner head for in-floor pool installations is needed.

SUMMARY OF THE INVENTION

Generally, a device for cleaning a swimming pool surface includes an insert defining a chamber, the insert having a lower surface disposed within the chamber at a top of the chamber. The device includes a piston carried in the chamber for reciprocal movement between a lowered position and a raised position in which the piston is in one of a plurality of indexed orientations. The piston rotates to an adjacent indexed orientation in response to reciprocation of the piston between the raised and lowered positions in response to the cyclical application of water flow through the chamber. A spring carried between the piston and the lower surface biases the piston into the lowered position. The piston includes a plurality of nozzles, and cap having an outlet is mounted for rotation among a plurality of positions, each aligning the outlet in the cap with one of the nozzles in the piston.

BRIEF DESCRIPTION OF THE DRAWINGS

Referring to the drawings.

DETAILED DESCRIPTION

Figure 1:
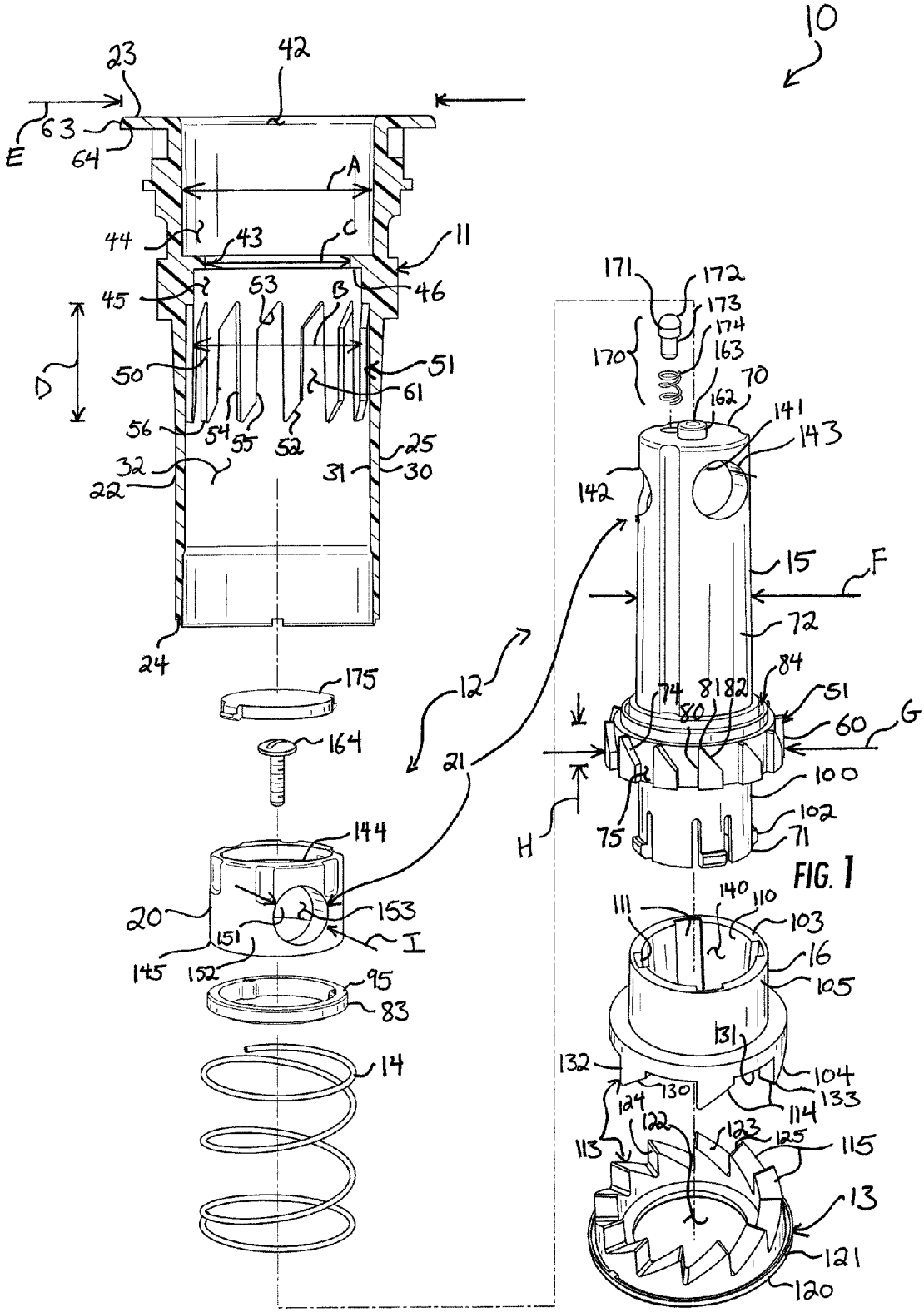
FIG. 1 is a combined section and exploded top perspective view of an in-floor pool cleaner head including an insert, a piston having a stem, a race, and a cap, a lower cap fitted onto the piston, and an end cap applied to the insert, wherein the insert is shown in section view and the piston, lower cap, and end cap are shown in a top perspective view.

Reference now is made to the drawings, in which the same reference characters are used throughout the different figures to designate the same elements. FIG. 1 illustrates in exploded view a reciprocating in-floor pool cleaner head 10. The head 10 includes a generally cylindrical insert 11, a generally cylindrical piston 12 carried for reciprocal movement in the insert 11, and an end cap 13. The head 10 is useful for cleaning a pool surface in a plurality of radial directions. Water is cyclically communicated to the head 10 to impart reciprocation to the piston 12 between a raised position and a lowered position. In response to water being applied to the head 10, the piston 12 moves into the raised position to eject water from the piston 12 along the pool surface so as to clean a portion of the pool surface. As the application of water is removed from the head 10, a spring 14 fit onto the piston urges the piston 12 back into a lowered position. When water is once again re-applied to the head 10, the piston 12 raises again to the raised position thereof, though the piston 12 is radially offset from its previous alignment in the raised position. This cyclical movement between the raised and lowered positions is repeated, with the piston 12 advancing radially each time and cleaning a different portion of the pool surface.

The piston 12 includes a stem 15, a cap 20, and a nozzle assembly 21 formed between the stem 15 and cap 20 which provides several differently-sized water discharge openings for selection by an operator. An operator can select and set the nozzle assembly 21 to discharge through an opening of a particular size, as will be described later, so that the head 10 performs optimally with the characteristics and requirements of the rest of the swimming pool system.

Figure 6:
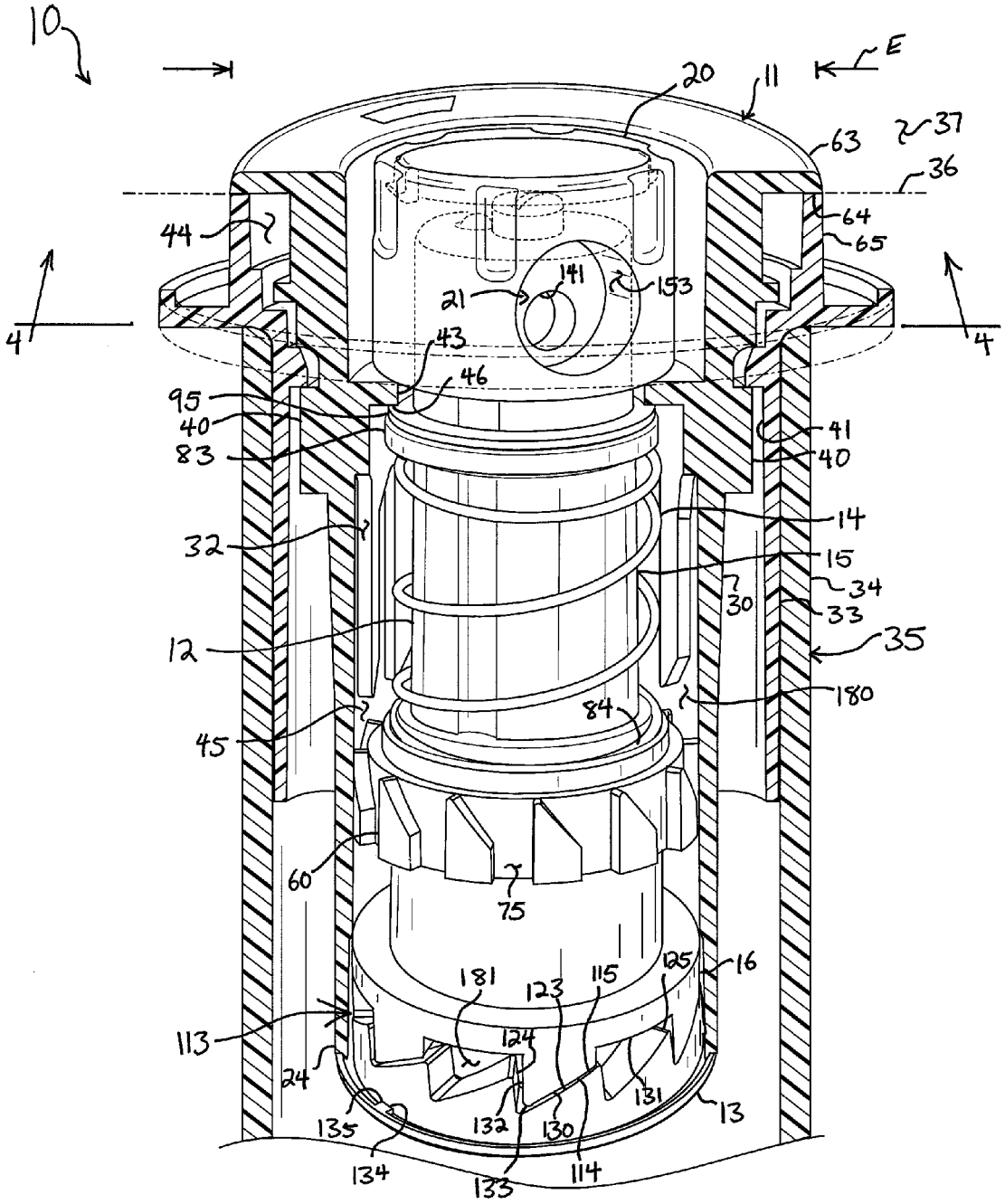
FIG. 6 is a partial section view of the head of FIG. 1 showing the stem, race, cap, lower cap, and end cap.

In FIG. 1, the insert 11 alone is shown in a section view bifurcating the insert 11. The insert 11 includes a generally cylindrical body 22 having a top 23, an opposed open bottom 24, and a continuous sidewall 25 extending between the top 23 and bottom 24. The sidewall 25 includes an outer surface 30 and an opposed inner surface 31, which, together with the top 23 of the insert 11 and the end cap 13 coupled to the bottom 24 of the insert 11, bound and define a generally cylindrical chamber 32 within the insert 11. In an installed condition, as shown in FIG. 6, the outer surface 30 of the insert 11 is received against a collar 33 applied to a terminal end 34 of a piping assembly 35 coupled to a pump and circulation system of a swimming pool structure 36, so that water is communicated through the piping assembly 35 and into the chamber 32 of the insert 11. The insert 11 includes tabs 40 which lock into corresponding grooves 41 formed in the collar 33, as shown in FIG. 6. One having reasonable skill in the art will understand the conventional structure of a swimming pool structure with a pump, circulation system, and piping assembly terminating in a collar, and as such, said structure is not shown or described.

With reference back to FIG. 1, the top 23 of the insert 11 is formed with a circular mouth 42 leading into the chamber 32. Generally intermediate with respect to the top 23 and bottom 24, an inward lip 43 extends radially into the chamber 32, bifurcating the chamber 32 into an upper chamber 43 and a lower chamber 44. The lip 43 has a lower surface 46 at the top of the lower chamber 44.

A set of elongate teeth 50, defining an engagement element of an upper engagement assembly 51, are formed along the inner surface 31 of the insert 11 in the lower chamber 44, are directed downward from the lip 43, and are formed with top lands 52. These teeth 50 are considered upper teeth of the upper engagement assembly 51, and are integrally formed to the inner surface 31, constituting projections extending radially inwardly slightly from the inner surface 31 and projecting axially downward continuously from the lip 43. Bottom lands 53 are formed between the teeth 50 opposite each tooth 50 from the top lands 52. The top and bottom lands 52 and 53 are each oriented in a clockwise direction when the insert 11 is viewed from a top 23-up orientation. Neighboring top and bottom lands 52 and 53 are parallel to each other and have generally the same width. The teeth 50 further include backs 54 and faces 55 which are parallel with respect to each other and oriented axially to the generally cylindrical body 22 of the insert 11, thereby defining an axial orientation of the teeth 50. The top and bottom lands 52 and 53 are each aligned transverse with respect to the axial orientation of the teeth 50. The teeth 50 each also include a tip 60 formed at a distal end of each tooth 50 between the back 54 and the top land 52. There are preferably twelve teeth 50, and the teeth 50 are structured and arranged for engaging with a complemental set of preferably twelve teeth 60 carried on the piston 12 when the piston 12 is in the raised position thereof. Those teeth 60 are considered lower teeth of the upper engagement assembly 51. The chamber 32 defines an inner diameter A, the teeth 50 define an inner diameter B, and the lip 43 defines an inner diameter C, as indicated in FIG. 1, and the diameter A is greater than the diameter B, and the diameter B is greater than the diameter C.

With continuing reference to FIG. 1, the back 43 of a tooth 50 and the opposing face 55 of an adjacent tooth 50 cooperate to bound an elongate channel 61 between the teeth 50. Twelve spaced-apart channels 61 are formed among the teeth 50, but only one channel 61 will be described herein, with the understanding that the description applies equally to the other channels 61. The channel 61 is aligned parallel to the axial orientation of the teeth 50, the body 22 of the insert 11, and the chamber 42 within the body 22. The channel 61 has a height D extending from an entrance proximate to the tip 56 of the tooth 50 to a terminal end at the bottom land 53 of the adjacent tooth 50. The channel 61 is aligned axially with the chamber 23 along the entire height D of the channel 61.

The channel 61, together with the back 54 and the face 55 bordering the channel 61, cooperate to define guide means 62, as shown in FIG. 1. The guide means 62 receive and guide the movement of the teeth 60 of the upper engagement assembly 51 carried on the piston 12 relative to the teeth 50 as the piston 12 reciprocates between the raised and lowered positions thereof. In this way, the guide means 62 guide rotation of the piston 12 during reciprocation of the piston 12 between the raised and lowered positions thereof. As will be described later, the channel 61 is aligned axially with respect to the chamber 32, and the piston 12 reciprocates within the chamber 32, causing the piston 12 to reciprocate axially with the channel 61 and rotate at the entrance and terminus of the channel 61.

Still referring to FIG. 1, the top 23 of the insert 11 has a thin, annular flange 63 extending radially outward from the sidewall 25. The flange 63 has a diameter E which is greater than the diameters A, B, and C, and has a lower surface 64 which is flat. In an installed condition of the head 10, shown in FIG. 6, the diameter E of the flange 63 is coextensive with the diameter of an upstanding lip 64 on the collar 33, so that the lower surface 64 of the flange 63 lies on top of, convers, and conceals the upstanding lip 64. The collar 33 is frequently a different color than that of the swimming pool structure 36, and so the flange 63 covers and conceals the color discrepancy. The flange 63 has one of a plurality of colors, which is selected to match or correspond to the color of the floor to provide a pleasing or subtle aesthetic. The insert 11 is constructed from a material or combination of materials having rigid, strong, durable, and corrosion- and oxidation-resistant material characteristics, such as acrylonitrile butadiene styrene ("ABS") or a similar plastic. The insert 11 has a matte finish which resists oxidation of the surface of the insert 11.

Referring back to FIG. 1, the piston 12 includes the stem 15, the cap 20, and a lower cap 16. The stem 15 includes a closed top 70, an opposed open bottom 71, and a generally cylindrical body 72. The lower cap 16 is releasably coupled to the open bottom 71 of the body 72. The body 72 of the stem 15 has a cylindrical sidewall 73 with an outer diameter F. The sidewall 73 extends from the top 70 of the stem 15 to the set of teeth 60 which define complemental engagement elements of the upper engagement assembly 51 for engagement with the teeth 50 when the piston 12 is in the raised position. The diameter F is constant between the top 70 and just above the teeth 60. The body 72 of the piston 12 has a diameter G across the teeth 60. The teeth 60 are directed upward toward the top 70 of the stem 15, and are oriented within the top lands 74 in a counter-clockwise direction when the piston 12 is viewed from a top 70-up orientation. Each tooth 60 in the set of teeth 60 is separated by a break 75 and has a back 80, a tip 81, and a face 82, as well as a height H, as shown in FIG. 1. The height H of each tooth 60 is less than the height D of the channels 61 in the insert 11, and the height D of each of the channels 61 is greater than the height H of the teeth 60. Each break 75 is reduced in diameter from the diameter G of the teeth 60 to the diameter F of the sidewall 73, so that the breaks 75 define the teeth 60 as separate, discrete protrusions extending radially outward from the body 72 of the piston 12. Each of the breaks 75 has a width between bounding the teeth 60 which corresponds to the width of the teeth 50 formed on the inner surface 31 of the insert 11, being just greater than the width of the teeth 50 so as to allow movement of the teeth 60 through the breaks 75. Likewise, each of the teeth 60 has a width which corresponds to the width of the channels 61 formed among the teeth 50 in the insert 11, being just less than the width of the channels 61 so as to allow movement of the teeth 60 through the channels 61.

Figure 3:
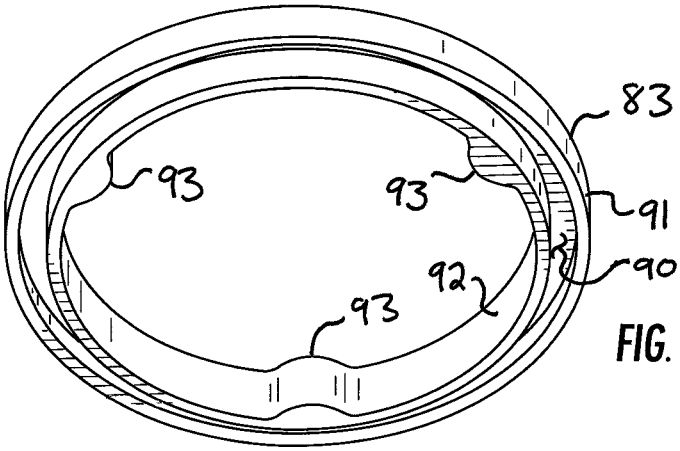
FIG. 3 is a bottom perspective view of the race of FIG. 1.
Figure 2:
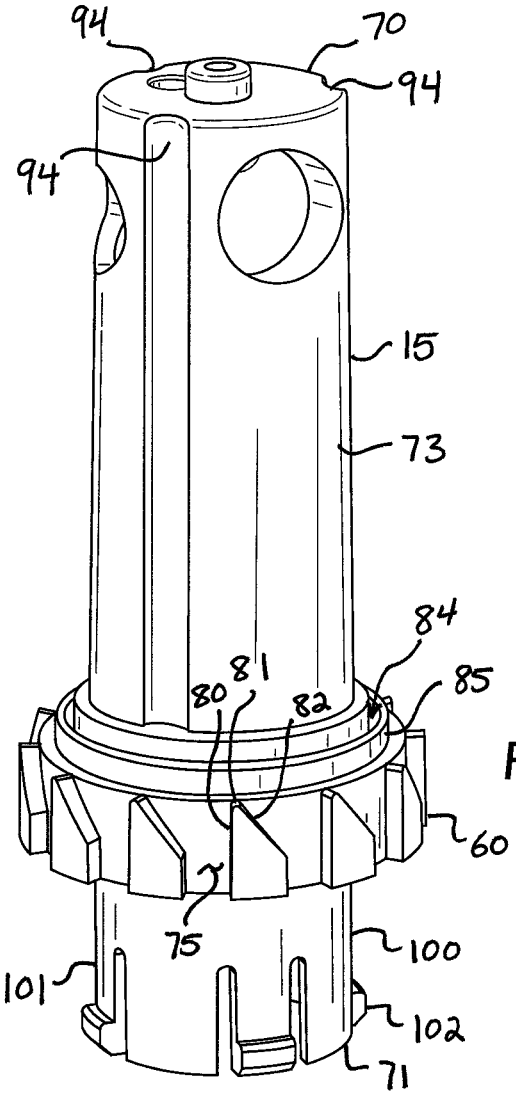
FIG. 2 is a top perspective view of the stem of FIG. 1.

The spring 14 is a helical compression spring carried on the body 72 between a race 83 fit over and onto the stem 15 and a channel 84 formed just above the teeth 60, and the spring 14 biases the piston 12 into the lowered position thereof. The spring 14 is entirely contained with the chamber 32. Turning to FIGS. 2 and 3, the channel 84 is a recessed seat defined by the sidewall 73 of the stem 15 on one side and an annular wall 85 set off circumferentially from the sidewall 73 on an opposed side. The channel 84 is a continuous seat completely encircling the sidewall 73, just above the teeth 60. The channel 84 is sized to receive the bottom of the spring 14.

The top of the spring is received in the race 83. The race 83 is a ring with a channel 90 formed into the bottom of the race 83. The channel 90 is defined between an outer wall 91 and an inner wall 92 of the race 83. The channel 90 is sized to receive the top of the spring 14. The inner wall 90 is formed with three protrusions or tabs 93 extending radially inwardly. The tabs 93 correspond and fit into three axial grooves 94 formed along and into the sidewall 73 of the stem 15. The stem 15 closely receives the race 83, such that the inner wall 92 slides in contact as a plain bearing along the sidewall 73 as the race 83 reciprocates on the stem 15. The tabs 93, fit into the grooves 94, prevent the race 83 from rotating during reciprocation of the piston 12. The race 83 slides between the lowered position of the piston 12 (shown in FIGS. 5A and 6) in which the spring 14 is fully extended, and the raised position of the piston 12 (shown in FIGS. 4A, 4B, 4C, and 5B) in which the spring 14 is fully compressed. While the race 83 reciprocates with respect to the stem 15, the race 83 remains generally stationary with respect to the insert 11. With reference now to FIG. 6, the race 83 is in a relative up position while the piston 12 is in the lowered position thereof. The spring 14 carried in the race 83 urges the spring 14 into the lowered position thereof. The race 83 is raised against the lip 43 bifurcating the chamber 32 into upper and lower chambers 44 and 45, with a low-friction washer 95 spaced between the race 83 and the lip 43 to reduce the friction and prevent damage to the race 83 and washer 95. The washer 95 is a bearing surface in contact against the lower surface 46 of the lip 43, allowing the washer 95—and the race 83 pressed against the washer 95—to rotate and slide smoothly against the lower surface 46.

The race 83 is thus continuously against, and below, the lip 43. As the piston 12 moves into the raised position, the race 83 remains in position against the lip 43, but the stem 15 rises and moves through the race 83 so that, with respect to the stem 15, the race 83 moves downward.

With the spring 14 seated in the channel 84 in the stem 15 and seated in the channel 90 in the race 83, the spring 14 is stabilized at its top and bottom. Additionally, the channels 84 and 90 are sized to closely receive the spring 14, so that the spring 14 cannot roll upon itself or bind on itself. The channels 84 and 90 prevent the spring 14 from deflecting laterally away from the stem 15 in a radial direction.

Referring to FIG. 1, the stem 15 terminates in a post 100 carried between the teeth 60 and the bottom 71, and is circumferentially slotted to define tabs 101 for snappedly receiving the lower cap 16. The tabs 101 are circumferentially spaced apart from each other at approximately ninety degrees, and each tab 101 is angled radially outward so as to project slightly beyond the post 100 and terminate in an enlarged head 102. The body 72 is constructed of a material or combination of materials having rigid, strong, durable, and corrosion- and oxidization-resistant material characteristics, such as ABS or a similar plastic. The tabs 101 are constructed of a material having flexible and shape-memory characteristics, such as plastic, which allows the tabs 101 to repeatedly flex and return to an original shape and position.

Figure 4A:
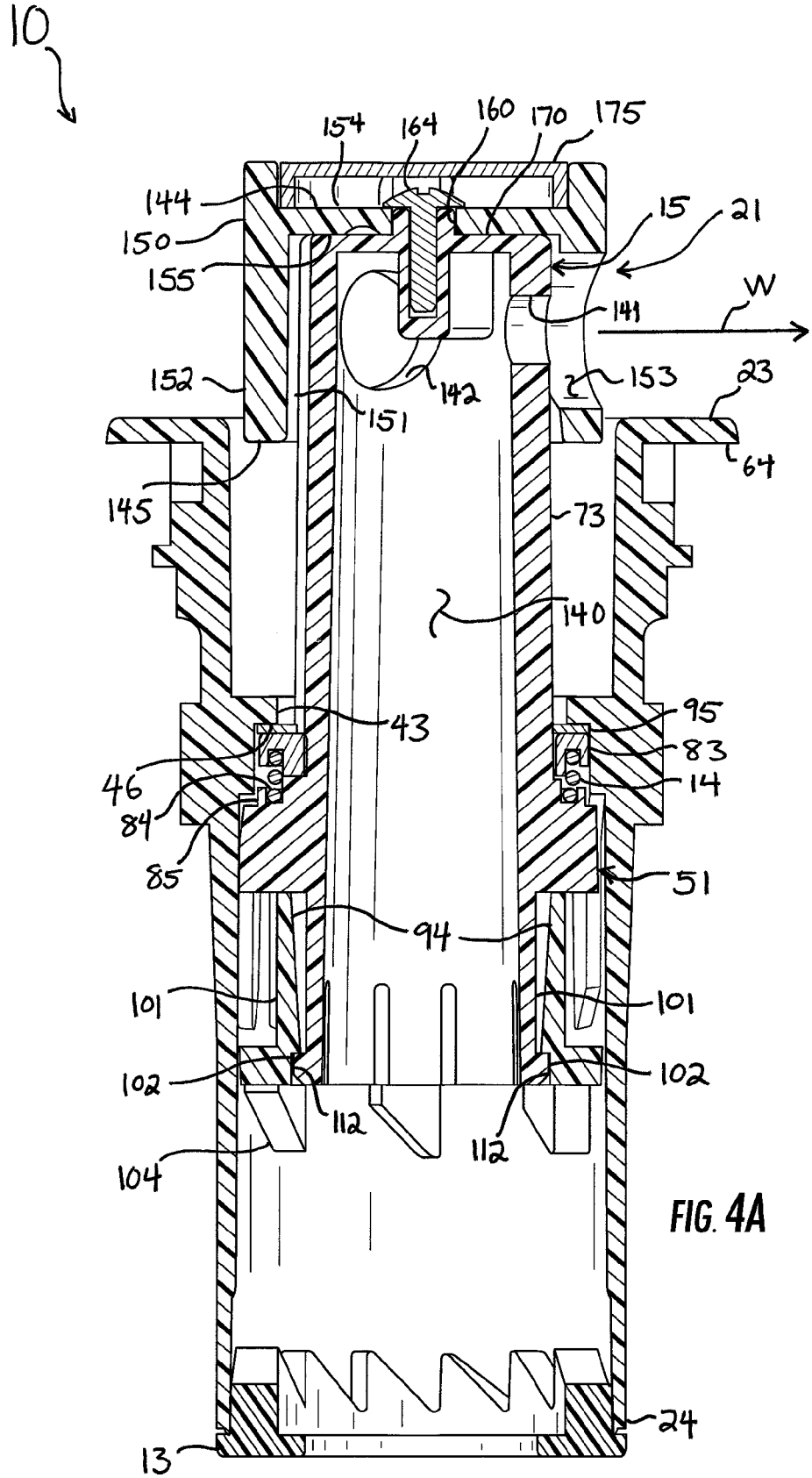
FIGS. 4A-4C are section views taken along the line 4-4 in FIG. 6 illustrating the cap of FIG. 1 adjusted on the stem of FIG. 1 in a plurality of alignments to form a plurality of nozzle assemblies between the cap and stem.
Figure 4B:
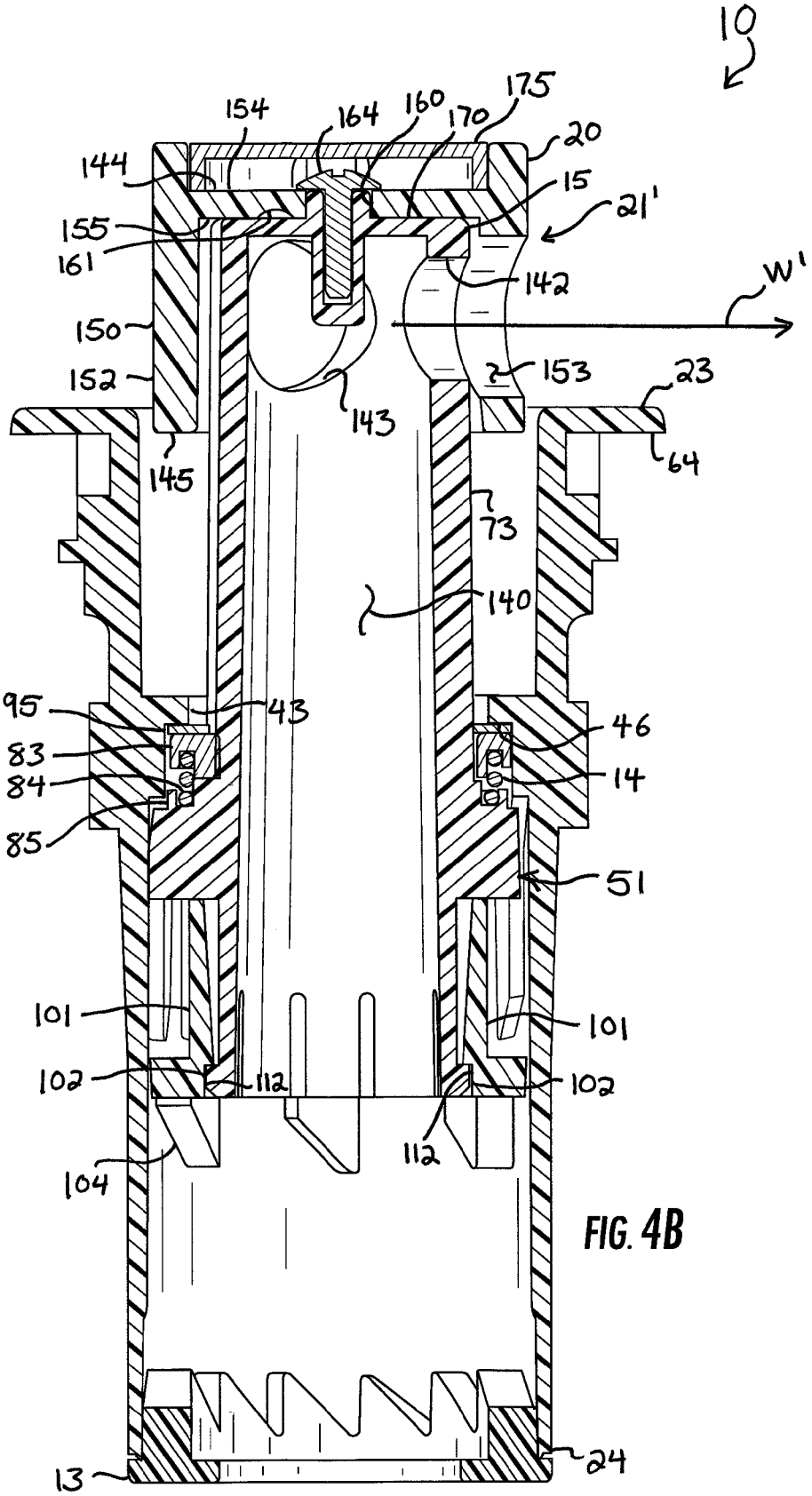

Still referring to the exploded view of FIG. 1, the lower cap 16 is structured to fit over the post 100. The lower cap 16 has an open top 103, an opposed open bottom 104, and a neck 105. An inner surface 110 of the neck 105 of the lower cap 16 is formed with axial grooves 111 for receiving the tabs 102 on the post 100 of the stem 15, and the grooves 111 terminate at notches 112 (shown in FIGS. 4A-4C) that snappedly receive the enlarged heads 160 of the tabs 101. Moreover, as seen in FIG. 4A, each groove 94 tapers radially inwardly from the top 103 to the bottom 104 of the lower cap 16 to bend each enlarged head 102 inwardly until the head 102 is received in the notch 94 into which the head 102 snaps and locks to prevent relative rotational movement of the post 15 and the lower cap 16.

Referring back to FIG. 1, a lower engagement assembly 113 is formed of a set of teeth 114 carried on the lower cap 16 of the piston 12 and a complemental set of teeth 115 carried on the end cap 13. The end cap 13 has an annular base 120 defined by an outer lip 121 and an opening 122 formed through the end cap 13 to allow water to flow through the end cap 13. The opening 122 is an inlet to the head 10 to communicate water from the piping assembly 35, through the chamber 32, and through the head 10. The teeth 115 extend axially upward away from the base 120 of the end cap 13 and are oriented with faces 123 in a clockwise direction when the end cap 13 is viewed from a teeth 115-up, base 120-down orientation. There are preferably twelve teeth 115, each tooth 115 having a face 123, an opposed back 124, and a tip 125. The opposing set of teeth 114 has preferably six teeth, half the number of teeth as the set of teeth 115. The teeth 114 project downwardly away from the lower cap 16. The teeth 114 have faces 130 oriented in a counter-clockwise direction when the lower cap 16 is viewed from a neck 105-up orientation, and the teeth 114 are spaced apart by bottom lands 131. Each tooth 114 has a back 132 opposed to the face 130, and a tip 133.

The end cap 13 is secured to the insert 11 to form a housing. With momentary reference to FIG. 6, an upstanding post 134 on the lip 121 of the end cap 13 closely fits into a corresponding notch 135 in the insert 11 to prevent rotational movement of the end cap 13 with respect to the insert 11 when the piston 12 moves into the lower position thereof and the teeth 114 on the piston 12 engage with the teeth 115 on the end cap 13. The end cap 13 is secured in a friction-fit engagement, and is further secured by adhesive, ultrasonic welding, or like fastening mechanism.

The head 10 is easy to assemble and operate. FIG. 6 illustrates the head 10 installed in the collar 33 applied to the terminal end 34 of the piping assembly 35. The tabs 40 of the insert 11 are locked into the collar 33. The collar 33 and the piping assembly 35 are applied in the pool structure 36. The pool structure 36, and portions of the collar 33 and the insert 11, are shown in broken line so as to allow clear illustration of the various structures and features of the piston 12. The pool, which holds water, is marked with the reference character 37.

To assemble the head 10 in the condition shown in FIG. 6, and with reference to structures shown in FIGS. 1 and 4A, the tabs 101 are aligned with the axial grooves 111 formed on the inner surface 111 of the lower cap 16, and the lower cap 16 is moved over the stem 158, with the grooves 111 slidably receiving the tabs 101 until the enlarged heads 102 of the tabs 101 snap into the notches 112 at the end of the grooves 111 proximate to the open bottom 104 of the lower cap 16. With the tabs 101 snappedly received in the notches 112, the lower cap 16 is secured onto the stem 15, and a blind fluid communication bore 140 (shown in FIGS. 1 and 4A) is formed centrally through the piston 12 from the open bottom 104 of the end cap 13 to the closed top 70 of the stem 15. The fluid communication bore 140 is in fluid communication with a plurality of nozzles 141, 142, and 143 formed in the sidewall 73 of the stem 15. Each of the nozzles 141, 142, and 143 is of a different diameter, with the nozzle 141 being the smallest and the nozzle 142 being the largest.

The stem 15 is ready for application into the chamber 32. The top 70 of the stem 15 is applied through the open bottom 24 of the insert 11 until the top 70 is disposed in the mouth 42 at the top 23 of the insert 11, and the bottom 104 of the lower cap 16 is proximate to the bottom 24 of the insert 11. The end cap 13 is then applied to the bottom 104 of the insert 11 in a friction-fit engagement, bounding and defining the chamber 32 therebetween, and the end cap 13 is prevented from rotation on the insert 11 by the interaction of the post 134 on the end cap 13 in the notch 135 in the insert 11, as shown in FIG. 6.

Once the stem 15 is applied into the chamber 32, the stem 15 is ready to receive the cap 20 thereon. Referring to FIG. 1, the cap 20 is a cap configured for rotatable mounting on the stem 15. The cap 20 has a closed top 144, an open bottom 145, and a generally cylindrical sidewall 150 extending between the top 144 and bottom 145. The sidewall 150 has an inner surface 151 and an opposed outer surface 152. An outlet 153 is formed completely through the sidewall 150, extending perpendicularly to a geometric axis of the cap 20 from the inner surface 151 through to the outer surface 152. The outlet 153 is round and has a diameter I.

The top 144 of the cap 20 has an upper surface 154 and an opposed lower surface 155, seen more clearly in FIG. 4A. A bore 160 is provided in the center of the top 144 through the upper and lower surfaces 154 and 155, and three hemispherical cavities 161 extend upwardly into the lower surface 155 offset from the bore 160. Each cavity 161 is spaced radially apart from the other by an equal angular distance. The bore 160 and cavities 161 provide the cap 20 with structure to rotate and lock in position on the stem 15.

Figure 4C:
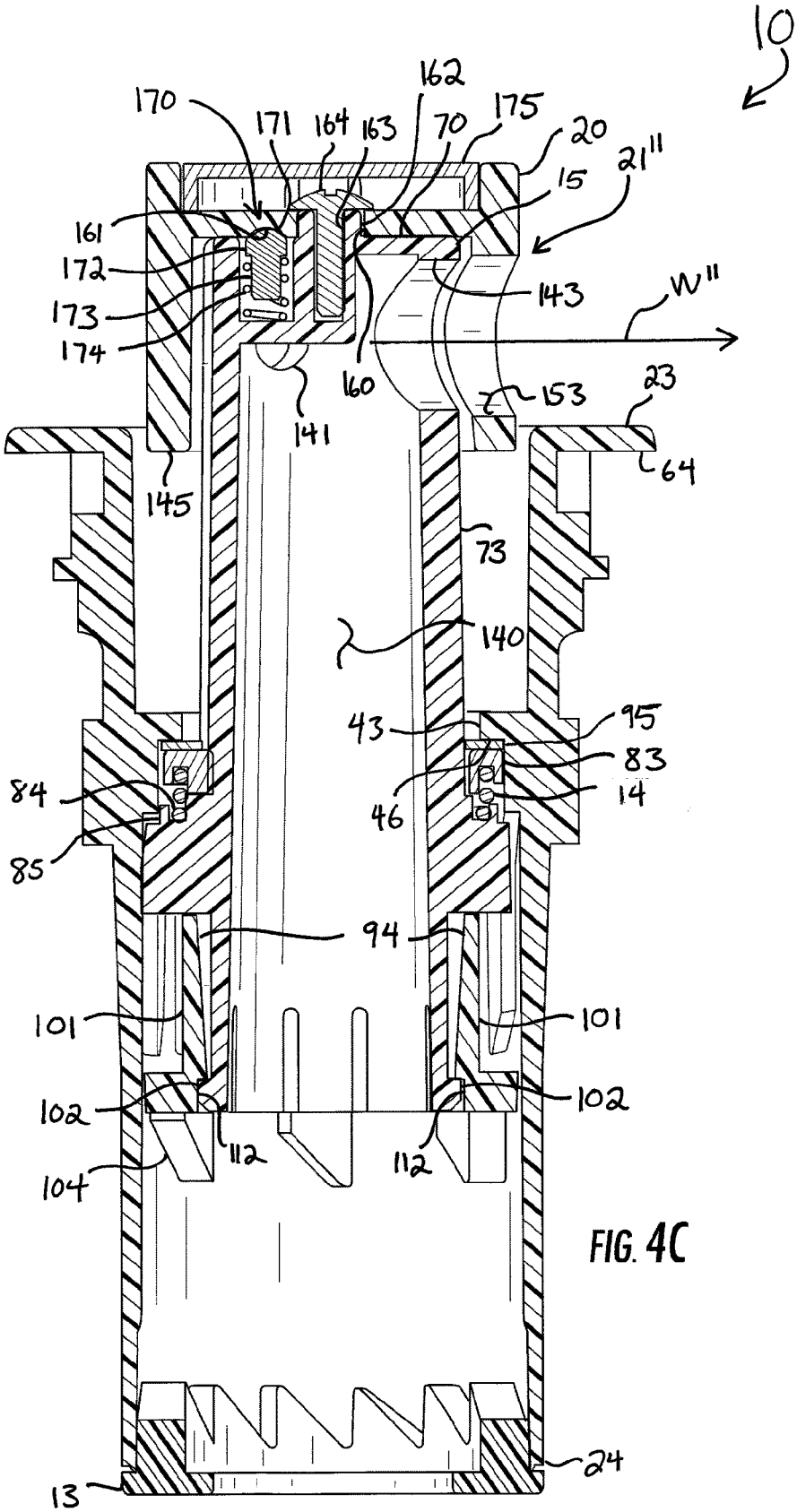
Figure 5A:
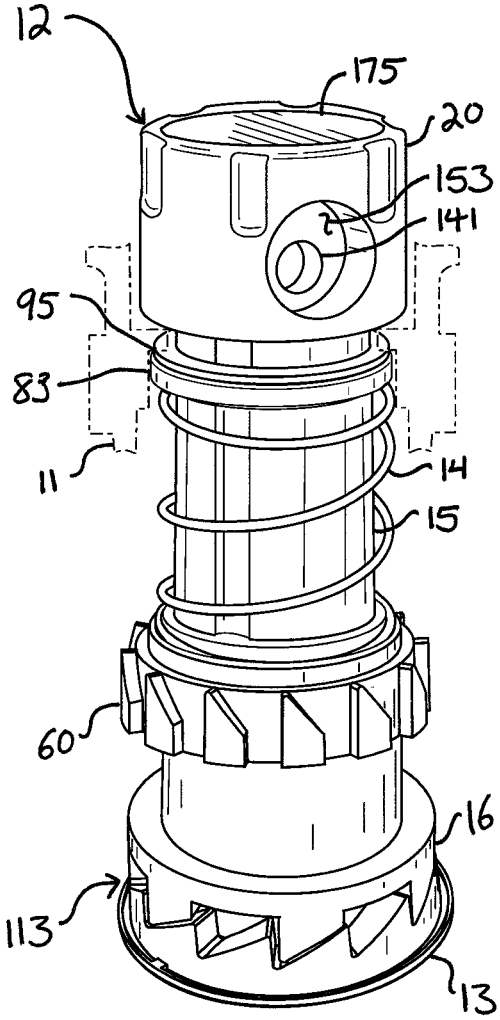
FIGS. 5A and 5B show, in isolation, the stem, race, and cap of the piston of FIG. 1, together with the lower cap, in a top perspective view.
Figure 5B:
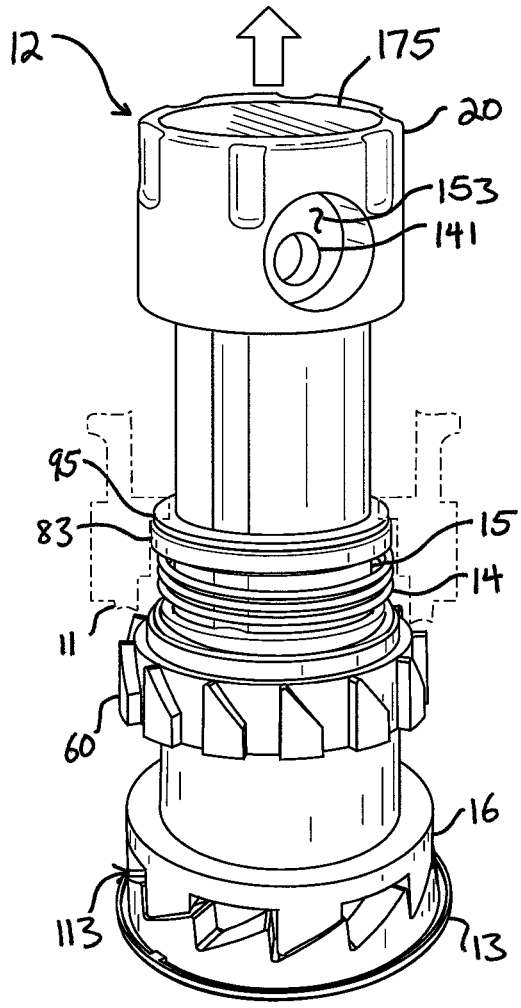

Returning to FIG. 1, and with additional reference to FIG. 4C, the top 70 of the stem 15 has a boss 162 protruding upwardly from the top 70 above the top 70 and also extending downward into a threaded slot 163 for receiving a fastener 164, such as a bolt or screw. The boss 162 is centered with respect to the round top 70 and projects above the top 70. A pocket 165 is formed proximate to the threaded slot 163, the pocket 165 extending downwardly from the top 70 and also being open at the top 70. The pocket 165 carries a detent assembly 170. The detent assembly 170 includes a detent 171 having an enlarged hemispherical head 172, a slender shank 173, and a spring 174 encircling the shank 173 and biasing the head 172 upwards. The detent assembly 170 is aligned with each of the cavities 161 in the top 144 of the cap 20, and each cavity 161 is sized and shaped to receive the hemispherical head 172 of the detent 171 when the detent assembly 170 aligns with the cavity 161 and the spring 174 urges the detent 171 upwards into the cavity 161.

The cap 20 is aligned with and placed over the top 70 of the stem 15 to encircle the stem 15 outside of the stem 15, and the fastener 164 is passed through the bore 160 in the top 144 of the cap 20 and into the threaded slot 163 in the top 70 of the stem 15. The head of the fastener 164 is wide and fits over both the boss 162 and the bore 160, acting to fasten the cap 20 onto the top 70 of the stem 15. The fastener 164 closely holds the cap 20 onto the stem 15 but allows for rotational movement of the cap 20. In this way, the cap 20 is mounted for rotation among a plurality of positions, each position being indexed by engagement of the detent assembly 170 with one of the cavities 161 and aligning the outlet 153 with one of the nozzles 141, 142, or 143 in the stem 15. A cover disc 175 snaps over the top 144 of the cap 20 to conceal the top 144 and the fastener 164.

The plurality of positions of the cap 20 on the stem 15 are illustrated in FIGS. 4A-4C. In FIG. 4A, a first position of the cap 20 aligned with the stem 15 is shown. In this first position, the outlet 153 is aligned with the nozzle 141. The nozzle 142 is shown moved away from the outlet 153. The nozzle 141 has the smallest diameter of the three nozzles 141, 142, and 143, which diameter is approximately one-third of the diameter I of the outlet 153 (shown in FIG. 1). Though not shown in FIG. 4A (but shown similarly in FIG. 4C), in this position, the detent assembly 170 is engaged with one of the cavities 161. The hemispherical head 172 of the detent 171 is biased into the hemispherical cavity 161 of the cap 20, thus locking the cap 20 on the stem 15 and preventing rotational movement of the cap 20. The cap 20 resists movement out of this first position, because the engagement of the detent assembly 170 in the cavity 161 resists relative rotational movement of the cap 20 and stem 15. This resistance is caused by the hemispherical head 172 of the detent 171 projecting above the top 70 of the stem and beyond the lower surface 155 of the top 144 of the cap 15. To rotate the cap 20 on the stem 15, a sufficient rotational force must be applied to the cap 20 to depress the hemispherical head 172 of the detent 171 below the lower surface 155 of the top 144 of the cap 15. Once the detent 171 is depressed, the cap 20 can then be rotated to the next position in the plurality of positions.

In this first position of the cap 20, water communicated upwardly through the fluid communication bore 140 is emitted outward through the nozzle assembly 21 formed by the outlet 153 and the nozzle 141 along line W, as shown in FIG. 4A. As water is emitted along line W, the water is first constricted through the nozzle 141 and then passes without obstruction through the outlet 153. The outlet 153 has a larger diameter than the nozzle 141, so that water moves smoothly through the nozzle assembly 21 without interruption, deflection, or without being diverted in any direction away from the line W. Further, water is prevented from exiting through nozzles 142 and 143 by the inner surface 151 of the cap 50.

In FIG. 4B, a second position of the cap 20 aligned with the stem 15 is shown. In this second position, the outlet 153 is aligned with the nozzle 142. The nozzle 143 is shown moved away from the outlet 153. The nozzle 142 has an intermediate diameter of the three nozzles 141, 142, and 143, which diameter is approximately two-thirds of the diameter I of the outlet 153 (shown in FIG. 1). Though not shown in FIG. 4B (but shown similarly in FIG. 4C), in this position, the detent assembly 170 is engaged with one of the cavities 161. The hemispherical head 172 of the detent 171 is biased into the hemispherical cavity 161 of the cap 20, thus locking the cap 20 on the stem 15 and preventing rotational movement of the cap 20. The cap 20 resists movement out of this second position, because the engagement of the detent assembly 170 in the cavity 161 resists relative rotational movement of the cap 20 and stem 15. This resistance is caused by the hemispherical head 172 of the detent 171 projecting above the top 70 of the stem and beyond the lower surface 155 of the top 144 of the cap 15. To rotate the cap 20 on the stem 15, a sufficient rotational force must be applied to the cap 20 to depress the hemispherical head 172 of the detent 171 below the lower surface 155 of the top 144 of the cap 15. Once the detent 171 is depressed, the cap 20 can then be rotated to the next position in the plurality of positions.

In this second position of the cap 20, water communicated upwardly through the fluid communication bore 140 is emitted outward through a nozzle assembly 21', formed by the outlet 153 and the nozzle 142 along line W', as shown in FIG. 4B. The nozzle assembly 21' is similar to the nozzle assembly 21 but is formed, as described here, with the nozzle 142 rather than the nozzle 141. As water is emitted along line W', the water is first constricted through the nozzle 142 and then passes without obstruction through the outlet 153. The outlet 153 has a larger diameter than the nozzle 142, so that water moves smoothly through the nozzle assembly 21' without interruption, deflection, and without being diverted in any direction away from the line W'. Further, water is prevented from exiting through nozzles 141 and 143 by the inner surface 151 of the cap 50.

In FIG. 4C, a third position of the cap 20 aligned with the stem 15 is shown. In this third position, the outlet 153 is aligned with the nozzle 143. The nozzle 143 is shown moved away from the outlet 153. The nozzle 143 has the largest diameter of the three nozzles 141, 142, and 143, which diameter is just less than the diameter I of the outlet 153 (shown in FIG. 1). In this position, the detent assembly 170 is engaged with one of the cavities 161. The hemispherical head 172 of the detent 171 is biased into the hemispherical cavity 161 of the cap 20, thus locking the cap 20 on the stem 15 and preventing rotational movement of the cap 20. The cap 20 resists movement out of this third position, because the engagement of the detent assembly 170 in the cavity 161 resists relative rotational movement of the cap 20 and stem 15. This resistance is caused by the hemispherical head 172 of the detent 171 projecting above the top 70 of the stem and beyond the lower surface 155 of the top 144 of the cap 15. To rotate the cap 20 on the stem 15, a sufficient rotational force must be applied to the cap 20 to depress the hemispherical head 172 of the detent 171 below the lower surface 155 of the top 144 of the cap 15. Once the detent 171 is depressed, the cap 20 can then be rotated to the next position in the plurality of positions.

In this third position of the cap 20, water communicated upwardly through the fluid communication bore 140 is emitted outward through the nozzle assembly 21" formed by the outlet 153 and the nozzle 143 along line W", as shown in FIG. 4C. The nozzle assembly 21" is similar to the nozzle assembly 21 but is formed, as described here, with the nozzle 143 rather than the nozzle 141. As water is emitted along line W", the water is first constricted through the nozzle 143 and then passes without obstruction through the outlet 153. The outlet 153 has a slightly larger diameter than the nozzle 143, so that water moves smoothly through the nozzle assembly 21" without interruption, deflection, and without being diverted in any direction away from the line W". Further, water is prevented from exiting through nozzles 141 and 142 by the inner surface 151 of the cap 50.

The cap 20 is thus arrangeable in each of the plurality of positions described above. Preferably, an operator sets the cap 20 to a selected position before the head 10 is installed into the collar 33. Doing so allows the operator to adjust the head 10 more easily than after the head 10 is already installing. The operator adjusts the cap 20 to select one of the differently-sized nozzles 141, 142, or 143 based on the design characteristics and requirements of the piping assembly 35, such as pressure and flow rate.

Once the piston 12 is properly adjusted, the head 10 is applied to the collar 33. Referring to FIG. 6, the collar 33 is pre-installed in the pool structure 33, having been installed during the formation of the pool structure 33, likely when the pool structure 33 was initially constructed. Generally, the upstanding lip 65 is flush with the surface of the pool structure 33. The head 10 is inserted into the collar 33, with the end cap 13 presented first, and the tabs 40 formed on the outer surface 30 of the insert 11 passing into the grooves 41 in the collar 33. The head 10 is completely inserted into the collar 33, so that the flange 63 is over the upstanding lip 65 of the collar 33 and the lower surface 64 of the flange 63 lies on top of and conceals the upstanding lip 64 and is flush with the surface of the pool structure 36. The insert 11 is then rotated to lock the tabs 40 into the grooves 41, thereby securely engaging the head 10 in the collar 33.

As shown in FIG. 6, the head 10 is now arranged in an assembled condition ready for operation, and includes the piston 12 carried within the chamber 32 for reciprocal movement, the end cap 13 applied to the bottom 24 of the insert 11, the lower cap 16 is secured on the stem 15 of the piston 12, and the spring 14 is seated in the channel 84 and the race 83. The piston 12 is arranged in FIG. 6 in the lowered position thereof with the nozzle assembly 21 directed out of the front of the page.

An annular gap 180 is formed between the insert 11 and the piston 12. The lower engagement assembly 113 is engaged, with the faces 130 of the teeth 114 of the piston 12 in contact with the faces 123 of the teeth 115 of the end cap 13, with the backs 132 of the teeth 114 of the piston 12 in contact with the backs 124 of the teeth 115 of the end cap 13, with the tips 133 of the teeth 114 of the piston 12 in contact between the faces 123 and the backs 124, and with the tips 125 of the teeth 115 in contact against the bottoms lands 131. Ports 181 are formed in the lower engagement assembly 113 in fluid communication with the chamber 32, the fluid communication bore 140, and the gap 180 when the teeth 114 and 115 come together, the ports 181 being defined as triangular spaces between the bottom lands 131 of the teeth 114 on the body 72 and the faces 123 and backs 124 on the end cap 13. The ports 193 extend radially through the lower engagement assembly 113 proximate to the bottom 24 of the insert 11 to communicate water radially through the lower engagement assembly 113.

Figure 7A:
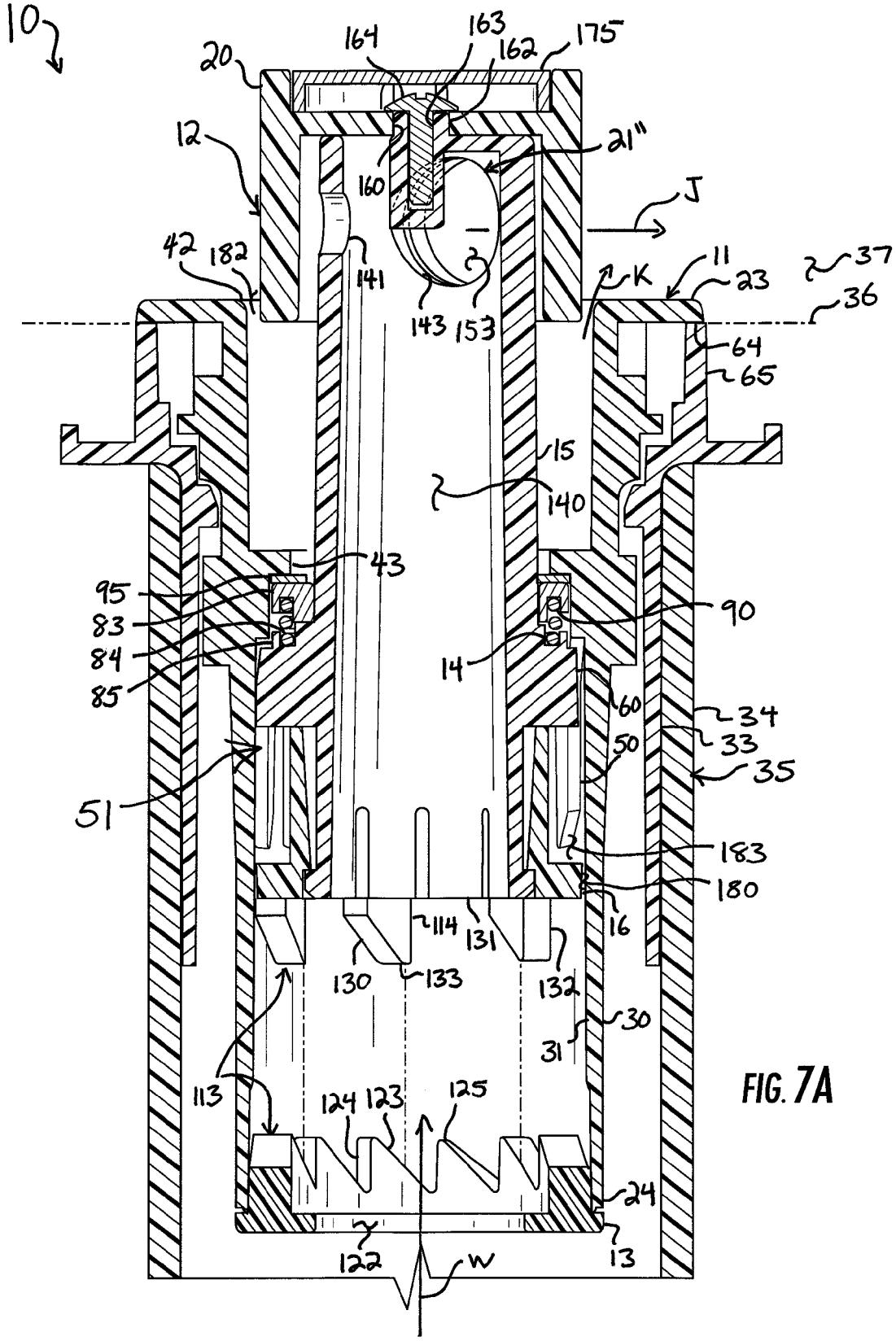
FIGS. 7A-7C are section views of the head of FIG. 1 taken along the line 4-4 in FIG. 6, showing the piston in a raised position and a first raised indexed orientation, a lowered position and a first lowered indexed orientation, and a raised position and a second raised indexed orientation, respectively.

Operation of the head 10 will now be discussed with reference to FIG. 6 and FIGS. 7A-7C. Water is cyclically applied through the head 10 from the piping assembly 35. When the application of water is removed from the head 10, the head 10 moves into the lowered position of the piston 12, as illustrated in FIG. 6, biased into the lowered position by the spring 14. When the application of water is returned to the head 10, water flows into the collar along a direction indicated by line W in FIG. 7A and through the opening 122 in the end cap 13 at the bottom 24 of the insert 11. Water moves into the chamber 32 and into the fluid communication bore 140, contacting the closed top 70 of the stem 15. In response to water being applied to the piston 12 at a force sufficient to overcome the opposing bias applied by the spring 14, the piston 12 moves into the raised position. In FIG. 7A, the piston 12 is in a first of twelve raised indexed orientations, wherein the term "orientation" is used to describe the angular direction of the nozzle assembly 21" of the piston 12, and each raised orientation is indexed because the piston 12 rotates sequentially among discrete, discontinuous orientations in response to the twelve teeth 60 on the stem 15 of the piston 12 enmeshing with the twelve teeth 50 of the insert 11 in twelve discrete, discontinuous arrangements as the piston 12 reciprocates between the raised and lowered positions.

Figure 7B:
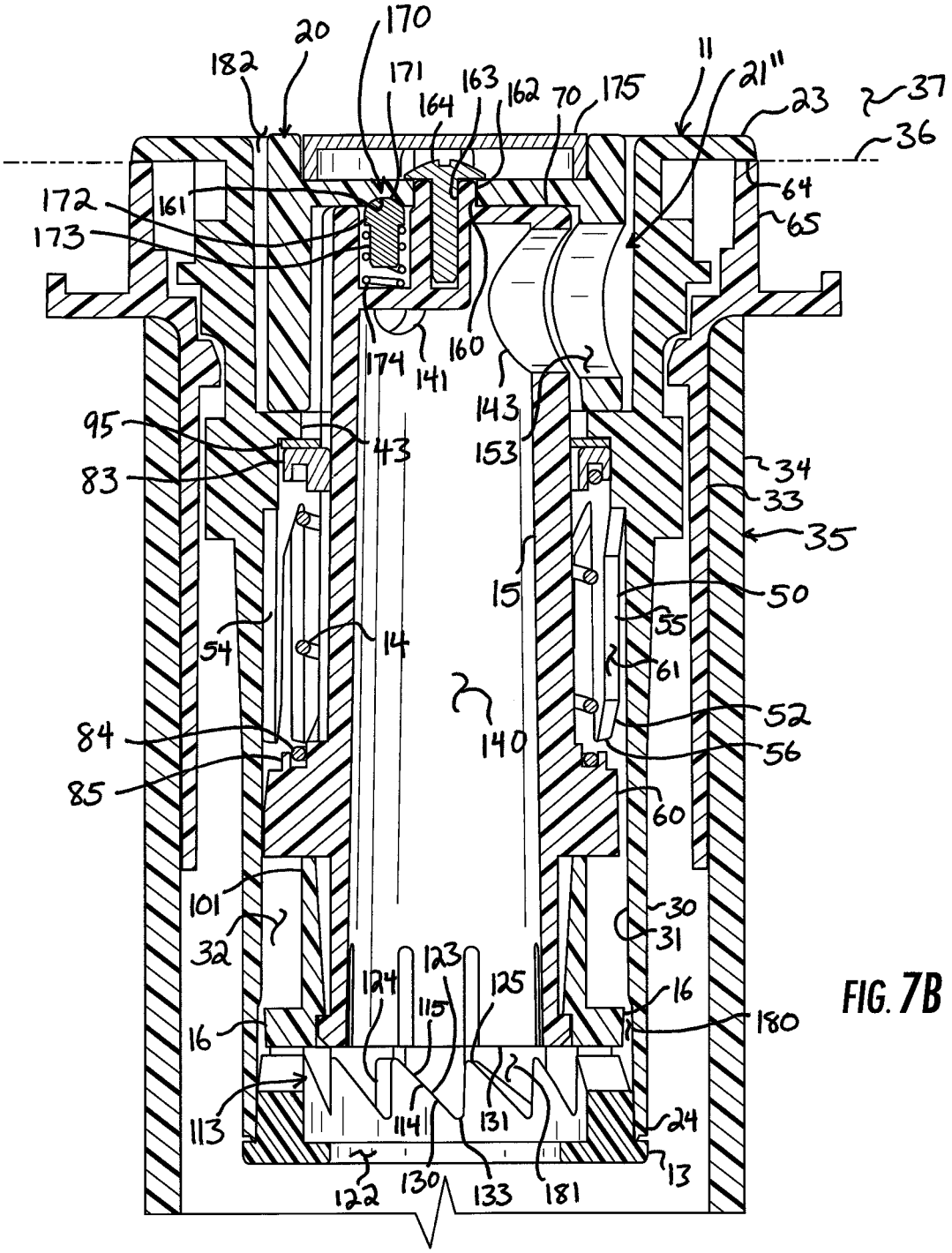
Figure 7C:
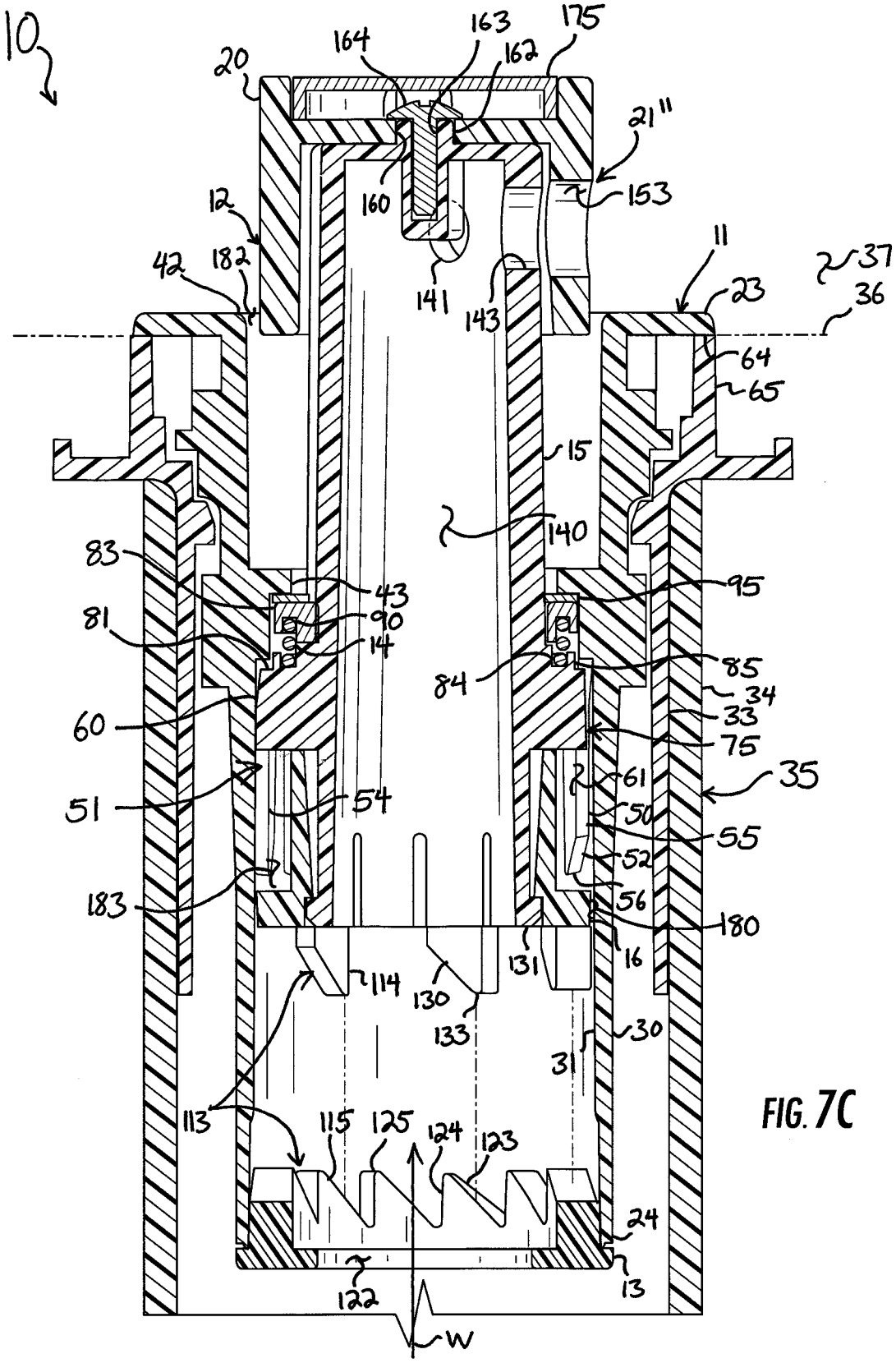

In the raised position of the piston 12, shown in FIG. 7A, the nozzle assembly 21" is above the top 23 of the insert 11 and free of obstruction, water flows through the fluid communication bore 140 of the piston 12 and out the nozzle 143 and the outlet 153. It should be understood that FIGS. 7A-7C show the nozzle 143 aligned with the outlet 153, and that, for purposes of brevity, only this alignment will be explained, with the understanding that the head 10 operates similarly when the nozzle 141 is aligned with the outlet 153 and when the nozzle 142 is aligned with the outlet 153. The nozzle assembly 21" directs a pressurized stream of water along line J across the surface of the pool structure 33, and as the nozzle assembly 21" is rotated into each adjacent orientation, the nozzle assembly 21" directs the pressurized stream of water across an adjacent portion of the surface. Water also flows around the piston 12 to exit through a minor outlet 182 at the top 23 of the insert 11. The outlet 182 is an annular gap formed between the diameter of the cap 20 and the diameter of the mouth 42. The outlet 182 is in fluid communication with the chamber 32 for communication of water from the chamber 32 out of the piston 12.

When the piston 12 is in the raised position and the upper twelve teeth 60 of the piston 12 are engaged with the lower twelve teeth 50 of the insert 11, ports 183 are formed below the teeth 60, and between the teeth 50 and the lower cap 16, allowing water to flow radially through the upper engagement assembly 51. As water is applied to the head 10 and enters the chamber 32, the water passes through the chamber 32, into the annular gap 180 spacing the piston 12 apart from the inner surface 31 of the insert 11, through the ports 183, and then through the gap 182 into the pool 190 along line K. Debris that may be carried into the head 10 and may later collect on the head 10 when the pump is not in operation or water is not being applied to the head 10, such as between the insert 11 and the piston 12, is thus moved through the head 10, preventing the piston 12 from becoming stuck in the insert 11 in the raised position as from debris, corrosion, or other mineral or material buildup. Additionally, with a port 183 formed between each of the teeth 50 and 60, each tooth 50 and 60 is cleaned of debris when the piston 12 moves into the raised position.

The teeth 50 are offset from the teeth 115, the teeth 60 are offset from the teeth 114, and in the raised position, the teeth 114 of the lower engagement assembly 113 are offset from the teeth 115, as indicated by the broken lines extending between the teeth 114 and 115 in FIG. 7A. The meshing engagement of the teeth 50 with the teeth 60 prevents rotational movement of the piston 12 and the nozzle assembly 21" with respect to the insert 11 in the raised position of the piston 12.

When the piston 12 is in the raised position, the spring 14 is compressed between the channel 90 in the race 83 and the channel 84 formed in the stem 15. The spring 14 is prevented from deviating or deflecting laterally by the outer wall 91 of the race 83 and by the annular wall 85 of the channel 84 in the stem 15. Further, when the race 83 and the channel 84 are brought in close proximity together when the piston 12 moves into the raised position, there is a very small annular gap defined between the race 83 and the channel 84, providing very little room for the spring 14 to deflect laterally. As such, the spring 14 is contained and prevented from deflecting laterally, which prevents the spring 14 from accidentally binding on itself and blocking the reciprocal movement of the piston 12 between the raised and lowered positions.

When the application of water is removed from the head 10, the piston 12 moves out of the raised position and into the lowered position, as shown in FIG. 7B. The spring 14, compressed between the channel 85, below, and the race 83, above, which is in juxtaposition with the washer 95 and the lip 43 bisecting the chamber 32, bias the piston 12 into the lowered position. As the piston 12 moves toward the lowered position, the upper engagement assembly 51 disengages and the teeth 50 and 60 separate. The tips 133 of the teeth 114 of the lower engagement assembly 113 are aligned above the faces 123 of the teeth 115. The piston 12 descends down within the insert 11 confined by the inner surface 31. The teeth 60 on the piston 12 pass through the channels 61 formed between the teeth 50 on the insert 11, and interaction of the teeth 60 against the backs 54 and faces 55 of the teeth 50 prevents the piston 12 from rotating with respect to the insert 11 as the piston 12 moves toward the lowered position.

After the teeth 60 clear the channels 61, passing beyond the tips 56 of the teeth 50, the tips 133 of the teeth 114 encounter the faces 123 of the teeth 115 and slide down the faces 123, causing the piston 12 to rotate, until the tips 133 are received between the faces 123 of the teeth 115 and the backs 124 of the teeth 115, so that the teeth 114 are engaged with the teeth 115, as shown in FIG. 7B, and prevented from relative rotational movement. Meshing engagement of the teeth 114 and 115 prevents rotational movement of the piston 12 and the nozzle assembly 21" with respect to the insert 11 in the lowered position of the piston 12.

In the lowered position of the piston 12, the ports 181 are formed between the teeth 114 and 115 allowing water to flow through the lower engagement assembly 113. Although water is not being forcibly applied through the head 10 by the pump, some water may pass through the head 10, such as at the completion or beginning of movement from the raised or lowered position, respectively, or if a swimmer causes a submerged pulse or wave of water to be moved against the head 10. The ports 181 allow water to pass through the head 10 among the chamber 32, the gap 180, and the fluid communication bore 140. Water moves into the head 10 by entering through the minor outlet 182 and then into the nozzle assembly 21", and also by entering through the minor outlet 182, into the gap 180 between the piston 12 and the inner surface 31 of the insert 11, and then through the ports 181. Similarly, water moves out of the head 10 by passing through the fluid communication bore 140, out the nozzle assembly 21", and out the minor outlet 182, and also by moving through the ports 181, through the gap 180, and out the minor outlet 182. In this way, the ports 181 allow water to move through the head 10 while the piston 12 is in the lowered position without moving the piston 12 to the raised position, so that debris which might have collected on the head when the pump was not in operation or water was not being applied to the head 10, such as between the insert 11 and the piston 12, is thus freed from and moved through the head 10, preventing the piston 12 from becoming stuck in the insert 11 in the lowered position as from debris, corrosion, or other mineral or material buildup.

In FIG. 7B, the piston 12 is in a first of twelve lowered indexed orientations, wherein each of the lowered orientation is indexed because the piston 12 rotates sequentially among discrete, discontinuous orientations in response to the six upper teeth 114 of the lower cap 16 enmeshing with the twelve lower teeth 115 of the end cap 13 in twelve discrete, discontinuous arrangements as the piston 12 reciprocates between the raised and lowered positions. The first lowered indexed orientation of the piston 12 is angularly offset from the first raised indexed orientations, as can be seen by the incremental rotation of the nozzle assembly 21" in a clockwise direction from FIG. 7A to FIG. 7B. Movement of the piston 12 from the raised position to the lowered position thus rotates the piston 12 one half step, and movement from the lowered position to the raised position rotates the piston 12 another half step, as will now be explained, so that movement of the piston 12 from the raised position to the lowered position and back to the raised position rotates the piston 12 one full step, which is one of twelve steps of a full revolution of the piston 12 with respect to the insert 11. With each half step, the piston moves to an adjacent, subsequent indexed orientation.

In the lowered position of the piston 12, the nozzle assembly 21" is just below the top 23 of the insert 11. The teeth 50 and 60 of the upper engagement assembly 51 are spaced apart from each other, and the teeth 50 are offset from the opposed teeth 60.

As water is cyclically applied from the piping assembly 35, the flow of water is returned to the head 10 and overcomes the bias applied by the spring 14, causing the piston 12 to move back into the raised position, shown in FIG. 7C. As the piston 12 moves toward the raised position, the lower engagement assembly 113 disengages and the teeth 114 and 115 separate. The tips 81 of the teeth 60 of the upper engagement assembly 51 are aligned below the top lands 52 of the teeth 50. The piston 12 rises up within the insert 11, confined by the inner surface 31, and the tips 81 of the teeth 60 encounter the top lands 52 of the teeth 50 and slide up the top lands 52. The tips 81 of the teeth 60 sliding upwards along the top lands 52 causes the piston 12 to rotate with respect to the insert 12 as the piston 12 rises, until the teeth 60 are positioned within the channels 61. With further movement of the piston 12 upward, the teeth 60 are received within the channels 61, and the breaks 75 formed between the teeth 60 receive the teeth 50.

Upward movement of the piston 12 continues axially until the tips 81 of the teeth 60 are received between the backs 54 and the faces 55 of the teeth 50, so that the teeth 60 are engaged with and seated in the teeth 50 and prevented from relative rotational movement. The backs 54 and faces 55 of the teeth 50 define a stop against which the teeth 60 are prevented from further upward movement, thus limiting the upward movement of the piston 12 relative to the insert 11. In the raised position, the ports 183 are again formed. As before in the first raised indexed orientation, debris that may be carried into the head 10, and that may collect on the head 10 and especially between the insert 11 and the piston 12, is moved through the head 10 by the flow of water through the head 10, preventing the piston 10 from becoming stuck in the raised position. Each tooth 50 and 60 is cleaned of debris when the piston 12 moves into the raised position.

In FIG. 7C, the piston 12 is in a second of twelve raised indexed orientations. The teeth 50 and 60 are meshingly engaged, and the teeth 60 are within the channels 61, preventing rotational movement of the piston 12 and the nozzle assembly 21" with respect to the insert 11. The second raised indexed orientation is adjacent to and angularly offset from the first indexed orientation by a full step, a discrete amount corresponding to the thickness of a tooth 50 between the back 54 and the face 55 of the tooth 50. The second raised indexed orientation is offset from the first lowered indexed orientation by a half step.

In this cycle of discrete half steps of angular movement of the piston 12 and the nozzle assembly 21", the nozzle assembly 21" is directed cyclically through twelve discrete orientations about the head 10. The piston 12 reciprocates between raised and lowered positions to rotate the piston 12 and nozzle assembly 21" discretely between each successive movement from the raised position to the lowered position, from the lowered position to the raised position, and so on. As the piston 12 reciprocates between the upper and lower positions, the upper engagement assembly 51 cyclically engages and disengages and the lower engagement assembly 113 cyclically disengages and engages. The piston 12 moves sequentially between the first raised indexed orientation, the first lowered indexed orientation, the second raised indexed orientation, the second lowered indexed orientation, and so on, with each movement rotating the piston 12 one half step further in revolution around with respect to the insert 11. In this way, the head 10 emits a stream of water through a full range of radial directions across the surface of the pool to clean the surface.

A preferred embodiment is fully and clearly described above so as to enable one having skill in the art to understand, make, and use the same. Those skilled in the art will recognize that modifications may be made to the described embodiment without departing from the spirit of the invention. To the extent that such modifications do not depart from the spirit of the invention, they are intended to be included within the scope thereof.

The invention claimed is:

1. A device for use in a swimming pool structure, the swimming pool structure including a pool and a circulation system having a piping assembly and a pump for cyclically communicating water through the piping assembly between the pool and the pump, and the piping assembly terminating in a collar installed in the swimming pool structure, the device comprising:

an insert defining a chamber coupled in fluid communication to the piping assembly through an inlet in the insert, the insert including a lower surface disposed within the chamber;

a piston including a plurality of nozzles;

a cap having an outlet, the cap mounted for rotation among a plurality of positions each aligning the outlet in the cap with one of the nozzles in the piston; and the piston is carried in the chamber for reciprocal movement between a lowered position and a raised position in which one of the nozzles is aligned with the outlet, and the one of the nozzles and the outlet are free of obstruction above the insert.

2. The device of claim 1, wherein the cap encircles the piston.

3. The device of claim 1, wherein the cap resists movement out of each of the plurality of positions.

4. The device of claim 1, wherein a detent carried by the cap resists movement of the cap out of each of the plurality of positions.

5. The device of claim 1, wherein a spring biases the piston into the lowered position.

6. The device of claim 5, wherein:

a channel is formed in the piston; and the spring is seated in the channel and prevented from lateral deviation by the channel.

7. The device of claim 5, wherein the spring is entirely contained within the chamber.

8. The device of claim 5, further comprising a race disposed between the spring and a lip in the chamber.

9. The device of claim 8, wherein the race has a bearing surface in contact against the lower surface, allowing the race to rotate against the lower surface.

10. The device of claim 8, wherein:

the race is formed with a channel; and the spring is seated in the channel and prevented from lateral deviation by the channel.

11. The device of claim 10, wherein:

a lower channel is formed in the piston; and the spring is seated in the lower channel and prevented from lateral deviation by the lower channel.

12. A device for use in a swimming pool structure, the swimming pool structure including a pool and a circulation system having a piping assembly and a pump for cyclically communicating water through the piping assembly between the pool and the pump, and the piping assembly terminating in a collar installed in the swimming pool structure, the device comprising:

an insert defining a chamber coupled in fluid communication to the piping assembly through an inlet in the insert, the insert including a lower surface disposed within the chamber;

a piston including a plurality of nozzles;

a cap having an outlet, the cap mounted for rotation among a plurality of positions each aligning the outlet in the cap with one of the nozzles in the piston;

the piston is carried in the chamber for reciprocal movement between a lowered position and a raised position in which the piston is in one of a plurality of indexed orientations and the one of the nozzles is free of obstruction above the insert; and the piston rotates to an adjacent indexed orientation in response to reciprocation of the piston between the raised and lowered positions in response to the cyclical application of water flow through the chamber.

13. The device of claim 12, wherein the cap encircles the piston.

14. The device of claim 12, wherein the cap resists movement out of each of the plurality of positions.

15. The device of claim 12, wherein a detent carried by the cap resists movement of the cap out of each of the plurality of positions.

16. The device of claim 12, wherein a spring biases the piston into the lowered position.

17. The device of claim 16, wherein:

a channel is formed in the piston; and the spring is seated in the channel and prevented from lateral deviation by the channel.

18. The device of claim 16, wherein the spring is entirely contained within the chamber.

19. The device of claim 16, further comprising a race disposed between the spring and a lip in the chamber.

20. The device of claim 19, wherein the race has a bearing surface in contact against the lower surface, allowing the race to rotate against the lower surface.

21. The device of claim 19, wherein:

the race is formed with a channel; and the spring is seated in the channel and prevented from lateral deviation by the channel.

22. The device of claim 21, wherein:

a lower channel is formed in the piston; and the spring is seated in the lower channel and prevented from lateral deviation by the lower channel.

* * * * *